US007561138B2

(12) United States Patent
Byun

(10) Patent No.: US 7,561,138 B2
(45) Date of Patent: Jul. 14, 2009

(54) LIQUID CRYSTAL DISPLAY DEVICE AND METHOD OF DRIVING THE SAME

(75) Inventor: Seung Chan Byun, Incheon (KR)

(73) Assignee: LG Display Co., Ltd., Seoul (KR)

( * ) Notice: Subject to any disclaimer, the term of this patent is extended or adjusted under 35 U.S.C. 154(b) by 620 days.

(21) Appl. No.: 11/446,198

(22) Filed: Jun. 5, 2006

(65) Prior Publication Data

US 2007/0146288 A1 Jun. 28, 2007

(30) Foreign Application Priority Data

Dec. 28, 2005 (KR) ..... 10-2005-0132270

(51) Int. Cl.
*G09G 3/36* (2006.01)

(52) U.S. Cl. ..... 345/98; 345/87

(58) Field of Classification Search ..... 345/55, 345/76, 77, 79, 84, 87, 90, 92, 94, 96, 98, 345/204, 208, 209, 211, 212, 213, 214, 215, 345/690

See application file for complete search history.

(56) References Cited

U.S. PATENT DOCUMENTS 6,778,158 B2 * 8/2004 Sun ..... 345/87
7,190,341 B2 * 3/2007 Yu ..... 345/98
2002/0075212 A1 * 6/2002 Song ..... 345/87
2005/0057465 A1 * 3/2005 Yu ..... 345/87

* cited by examiner

*Primary Examiner*—My-Chau T Tran
(74) *Attorney, Agent, or Firm*—McKenna Long & Aldridge LLP

(57) ABSTRACT

A display device according to the present invention includes a pixel array including a plurality of gate lines and a plurality of data lines crossing each other to define pixel regions and a plurality of first thin film transistors near the crossings, the first thin film transistors supplying pixel voltages to pixel electrodes of the pixel regions; a gate driving circuit to sequentially supply a scanning pulse to the gate lines; a data driving circuit to supply the pixel voltages to the data lines; and a pre-charging circuit including a plurality of second thin film transistors, the second thin film transistor connected to the nth (wherein, n is an integer) gate line and turned on by the scanning pulse applied to the nth gate line, the pre-charging circuit supplying a voltage higher than a threshold voltage of the first thin film transistors to the (n+2)th gate line.

20 Claims, 5 Drawing Sheets

FIG. 2
RELATED ART (a)

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

(b)

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

LIQUID CRYSTAL DISPLAY DEVICE AND METHOD OF DRIVING THE SAME

This application claims the benefit of Korean Patent Application No. P2005-0132270, filed on Dec. 28, 2005, which is hereby incorporated by reference for all purposes as if fully set forth herein.

BACKGROUND OF THE INVENTION

1. Field of the Invention

The present invention relates to a liquid crystal display device, and more particularly to a liquid crystal display device and method of driving the same that can have a pre-charging effect without modifying the structures of the gate drive integrated circuits.

2. Description of the Related Art

Recently, liquid crystal display (LCD) devices are being more widely used in a variety of electronic products because of their features such as lightweight, slimness, low power consumption and so on. According to such a trend, the LCD devices have been used in office automation equipment, audio and video equipment and so on. A liquid crystal display device controls a light transmittance in accordance with a signal applied to a plurality of switching devices arranged in a matrix to display desired pictures on a screen. Thin film transistors (TFT) are mainly employed for the switching devices.

Referring to FIG. 1, an LCD device according to the related art includes a liquid crystal display panel 3 in which data lines DL_1 to DL_m cross gate lines GL_1 to GL_n and a TFT is arranged at each crossing for supplying a pixel voltage to a liquid crystal cell Clc. The LCD device further includes a gate driving circuit 2 for supplying a scanning pulse to the gate lines GL_1 to GL_n, a data driving circuit 1 for supplying pixel voltages to the data lines DL_1 to DL_m ; and a timing controller 4 for controlling the gate driving circuit 2 and the data driving circuit 1.

The TFTs supply pixel voltages to the liquid crystal cells Clc via the data lines DL in response to the scanning pulse from the gate lines GL. To this end, a gate electrode of the TFT is connected to the gate line GL, a source electrode of the TFT is connected to the data line DL, and a drain electrode of the TFT is connected to a pixel electrode of the liquid crystal cell Clc. The liquid crystal cell Clc is driven by a voltage difference between a common voltage Vcom supplied to a common electrode and the pixel voltage supplied to the pixel electrode. In each of the liquid crystal cells Clc, a storage capacitor Cst is formed. The storage capacitor Cst may be formed between the pixel electrode of the liquid crystal cell Clc and a pre-stage gate line or between the pixel electrode of the liquid crystal cell Clc and a common electrode line to maintain the pixel voltage in the liquid crystal cell Clc.

The timing controller 4 controls the data driver 1 and the gate driver 2, and supplies digital video signals synchronized to a clock signal to the data driver 1 from a graphic card. The data driver 1 converts the digital video signals supplied from the timing controller 4 into analog video signals (pixel voltages) and supplies the analog video signals to the data lines DL_1 to DL_m to drive the liquid crystal cells Clc in the liquid crystal panel 3. The gate driver 2 sequentially supplies the scanning pulse to the gate lines GL_1 to GL_n to supply the analog video signals to the liquid crystal cells Clc connected to the selected gate line.

In order to prevent flicker and deterioration of liquid crystal in the liquid crystal cells Clc, an inversion driving method may be employed in which the polarity of the video signal supplied to the liquid crystal cell Clc is switched in a designated period. The examples of the inversion driving method are a frame inversion method, a line inversion method, a column inversion method, a dot inversion method, etc. Among these inversion methods, the dot inversion method is generally used in middle to large-size LCD panels.

FIG. 2 is a schematic view illustrating a dot inversion method in which different polarities of the video signal are supplied to each pixel of the liquid crystal panel 3.

Referring to FIG. 2, one square represents one pixel that includes R, G and B sub-pixels. Each of the R, G and B sub-pixels corresponds to one liquid crystal cell Clc. The symbol "+" represents a video signal having a positive polarity and the symbol "−" represents a video signal having a negative polarity supplied to the pixel. Further, FIG. 2(*a*) and FIG. 2(*b*) show that the polarities of the pixels are switched after one frame interval. In the dot inversion method, the polarity of the pixel voltage applied to a given pixel is different from the polarities of the pixel voltages applied to the adjacent pixels and is inverted every frame. For instance, in the first frame, the polarities of the video signals shown in FIG. 2(*a*) are supplied to the pixels, and then in the second frame, the polarities of the video signals shown in FIG. 2(*b*) are supplied to the pixels.

However, the LCD device driven by such an inversion driving method consumes a large amount of current and the data integrated circuit of the LCD device generates a large amount of heat. To solve such problems, a driving scheme in which the swing width of the pixel voltages is reduced by pre-charging the liquid crystal cells Clc has been suggested. More particularly, when the TFTs connected to nth horizontal line are turned on to supply the pixel voltages to the pixels of the nth horizontal line, the TFTs connected to (n+2)th horizontal line are also turned on to pre-charge the pixels of the (n+2)th horizontal line. As illustrated in FIG. 2, the polarities of the pixel voltages supplied to the pixels of the nth horizontal line are the same as the polarities of the pixel voltages supplied to the pixels of the (n+2)th horizontal line in the dot inversion driving method.

To simultaneously turn on the TFTs connected to the nth horizontal line and the (n+2)th horizontal line, the nth gate line can be simply connected to the (n+2)th gate line. However, in such a case, the pixel voltages already charged in the pixels of the nth gate line can be negatively affected when the TFTs of the (n+2)th horizontal line are turned on. Accordingly, a variety of driving schemes that include changes in the structure of the gate drive integrated circuit have been suggested, but because of the changes in the gate drive integrated circuit, these driving schemes increase the production cost of the LCD device.

SUMMARY OF THE INVENTION

Accordingly, the present invention is directed to a liquid crystal display device and method of driving the same that substantially obviates one or more of the problems due to limitations and disadvantages of the related art.

An advantage of the present invention is to provide to a liquid crystal display device and method of driving the same that can have a pre-charging effect without modifying the structures of the gate drive integrated circuits.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device includes display device includes a pixel array including a plurality of gate lines and a plurality of data lines crossing each other to define pixel regions and a plurality of first thin film transistors near the crossings, the first thin film transistors supplying pixel voltages to pixel electrodes of the pixel regions; a gate driving circuit to sequentially supply a scanning pulse to the gate lines; a data driving circuit to supply the pixel voltages to the data lines; and a pre-charging circuit including a plurality of second thin film transistors, the second thin film transistor connected to the nth gate line and turned on by the scanning pulse applied to the nth gate line, the pre-charging circuit supplying a voltage higher than a threshold voltage of the first thin film transistors to the (n+2)th gate line.

In another aspect of the present invention, a method of driving a display device, the display device including a pixel array in which a plurality of gate lines cross a plurality of data lines to define pixel regions and a plurality of first thin film transistors near the crossings, the first thin film transistors supplying pixel voltages to pixel electrodes of the pixel regions, the method includes sequentially supplying a scanning pulse to the gate lines; supplying the pixel voltages to the data lines according to a dot inversion method; and supplying a voltage higher than a threshold of the first thin film transistors to the (n+2)th gate line using a second thin film transistor turned on in accordance with the scanning pulse supplied to the nth gate line.

In yet another aspect of the present invention, a pre-charge device for pre-charging pixels of a display device having a plurality of gate lines and a plurality of data lines crossing each other and a plurality of first thin film transistors near the crossings for supplying pixel voltages to the pixels, the pre-charge device includes a voltage generator to supply a voltage higher than a threshold voltage of the first thin film transistors; and a plurality of second thin film transistors, one of the second thin film transistors turned on by a scanning pulse applied to the nth gate line to supply the voltage higher than the threshold voltage of the first thin film transistors to the (n+2)th gate line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 2 is a schematic view illustrating a dot inversion method;

DETAILED DESCRIPTION OF THE ILLUSTRATED EMBODIMENT

Reference will now be made in detail to embodiments of the present invention, examples of which are illustrated in the accompanying drawings.

Figure 1:
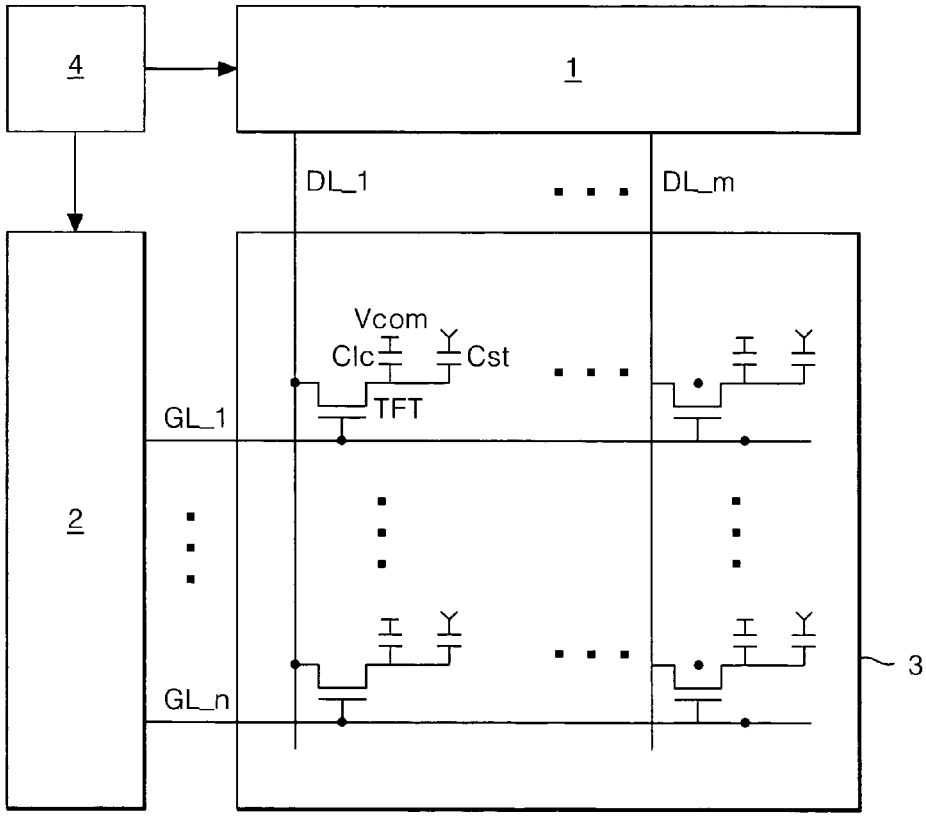
FIG. 1 RELATED ART
FIG. 1 is a schematic view illustrating a liquid crystal display (LCD) device according to the related art.
Figure 3:
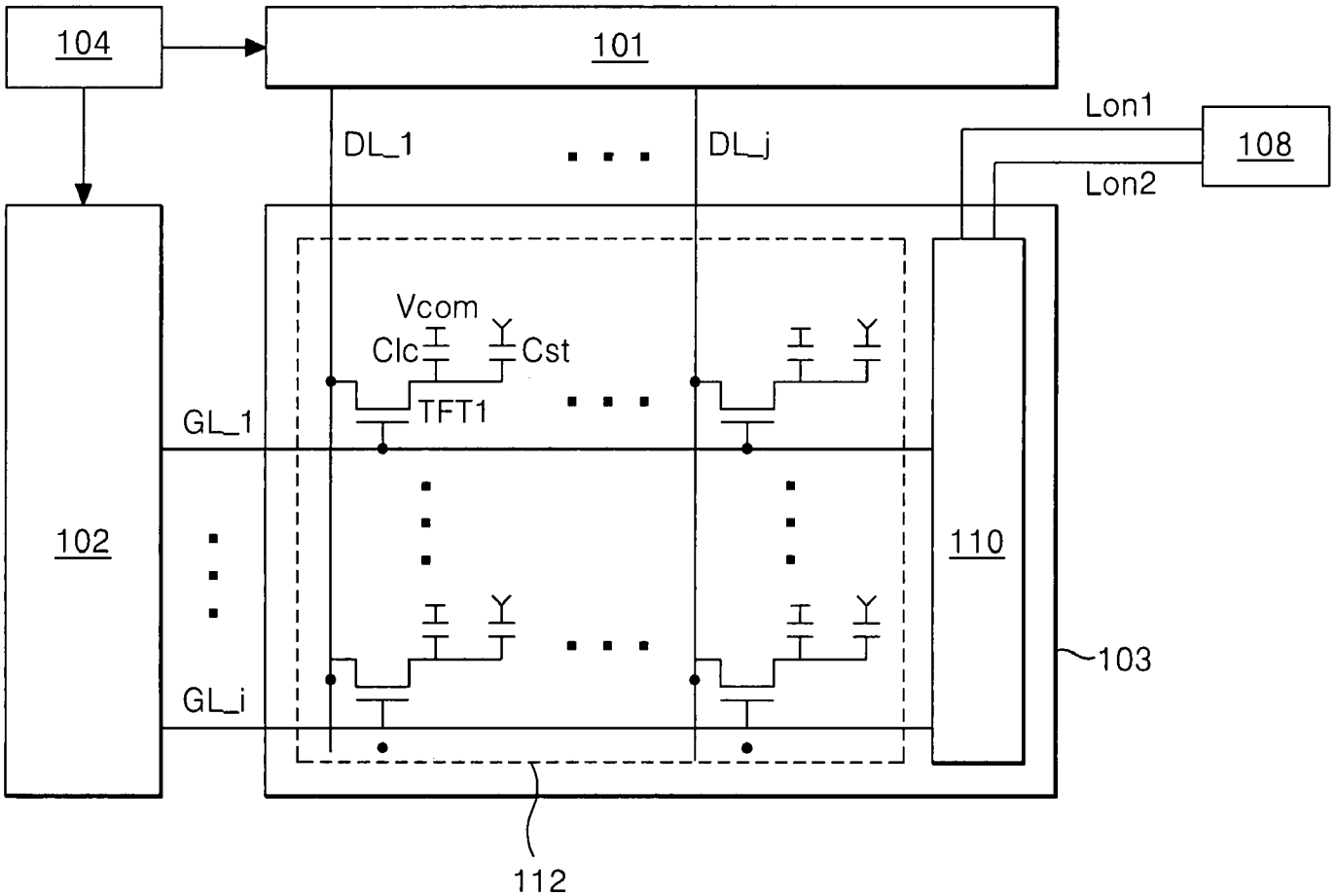
FIG. 3 is schematic view illustrating a liquid crystal display (LCD) device according to an embodiment of the present invention.

FIG. 3 is schematic view illustrating a liquid crystal display (LCD) device according to an embodiment of the present invention.

Referring to FIG. 3, a liquid crystal display (LCD) device according to the present invention includes a liquid crystal display panel 103 in which data lines DL_1 to DL_j using the nth second thin film transistor connected to the nth gate line cross gate lines GL_1 to GL_i and a pixel array 112 is provided with a plurality of first thin film transistors TFT1 formed near the crossings to supply pixel voltages to liquid crystal cells Clc. The LCD device further includes: a pre-charging circuit 110 to supply a voltage higher than a threshold voltage of the first thin film transistor TFT1 to the (n+2)th gate line GL_n+2 when a scanning pulse is supplied to the nth gate line GL_n; a voltage generator 108 to generate a driving voltage for driving the pre-charging circuit 110; a gate driving circuit 102 to sequentially supply a scanning pulse to the gate lines GL_1 to GL_i; and a data driving circuit 101 to supply pixel voltages to the data lines DL_1 to DL_j. The polarity of the pixel voltages supplied to a given data line is different from the polarity of the pixel voltages supplied to the adjacent data line and is converted every frame when a line inversion method or a dot inversion method is applied. Also, The polarity of the pixel voltages supplied to a given pixel is different from the polarities of the pixel voltages supplied to the adjacent pixel and is converted every frame according to a dot inversion method.

The first thin film transistors TFT1 supply pixel voltages to the liquid crystal cells Clc in response to the scanning pulse from the gate lines GL. To this end, a gate electrode of the first thin film transistor TFT1 is connected to the gate line GL, a source electrode of the TFT1 is connected to the data lines DL and a drain electrode of the TFT1 is connected to a pixel electrode of the liquid crystal cell Clc. The liquid crystal cell Clc is driven by a voltage difference between a pixel voltage supplied to the pixel electrode and a common voltage Vcom provided to a common electrode (not shown). In each of the liquid crystal cells Clc, a storage capacitor Cst is formed. The storage capacitor Cst may be formed between the pixel electrode of the liquid crystal cell Clc and a pre-stage gate line or between the pixel electrode of the liquid crystal cell Clc and a common electrode line to maintain the pixel voltage charged in the liquid crystal cell Clc.

A timing controller 104 controls the data driver 101 and the gate driver 102, and supplies digital video signals synchronized to a clock signal to the data driver 101 from a graphic card. The data driver 101 converts the digital video signals supplied from the timing controller 104 into analog video signals (pixel voltages) and supplies the analog video signals to the data lines DL_1 to DL_j to drive the liquid crystal cells Clc in the liquid crystal panel 103. The gate driver 102 sequentially supplies the scanning pulse synchronized to the video signals to the gate lines GL_1 to GL_i.

Figure 4:
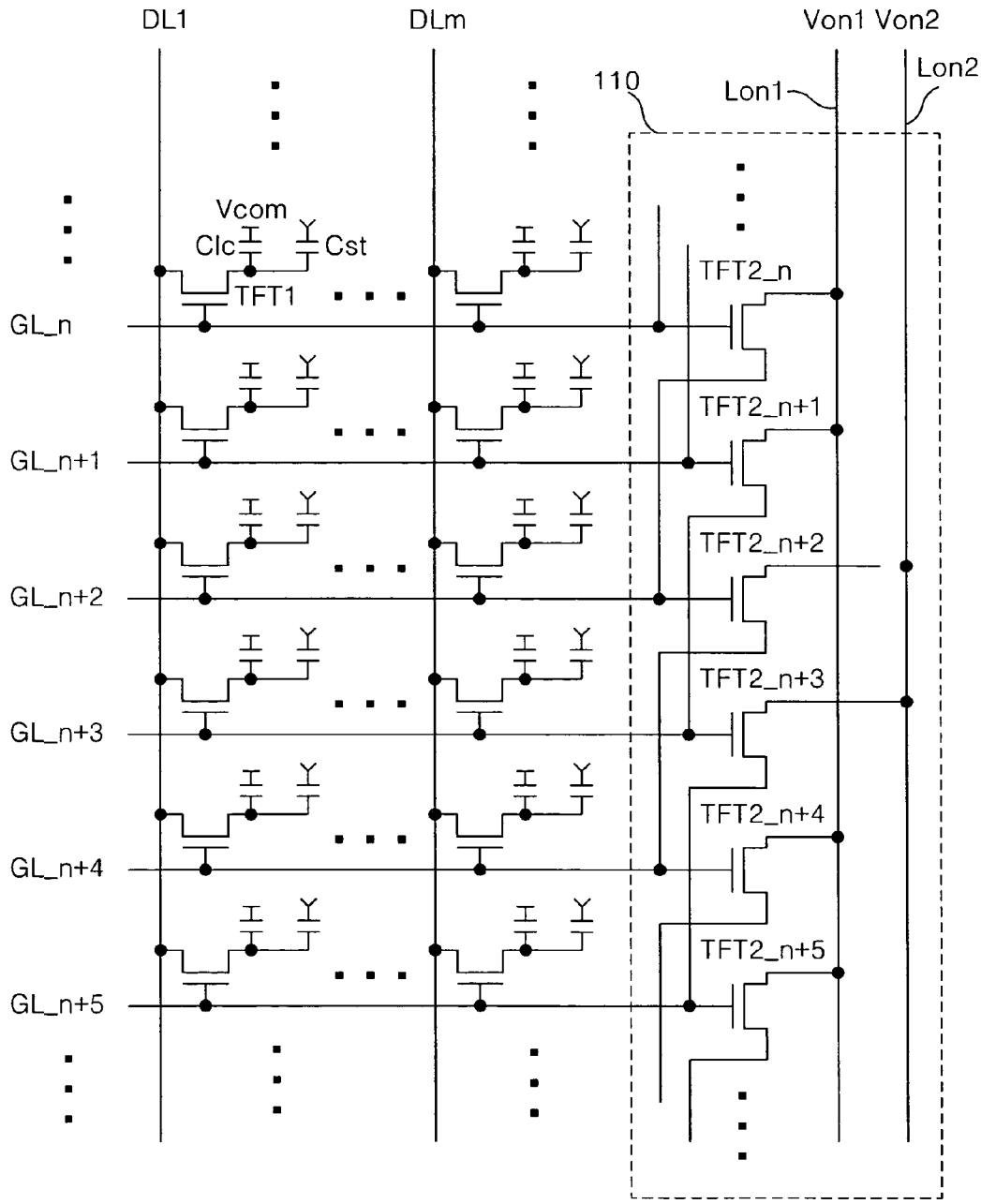
FIG. 4 is a view illustrating the pre-charging circuit shown in FIG. 3.
Figure 5:
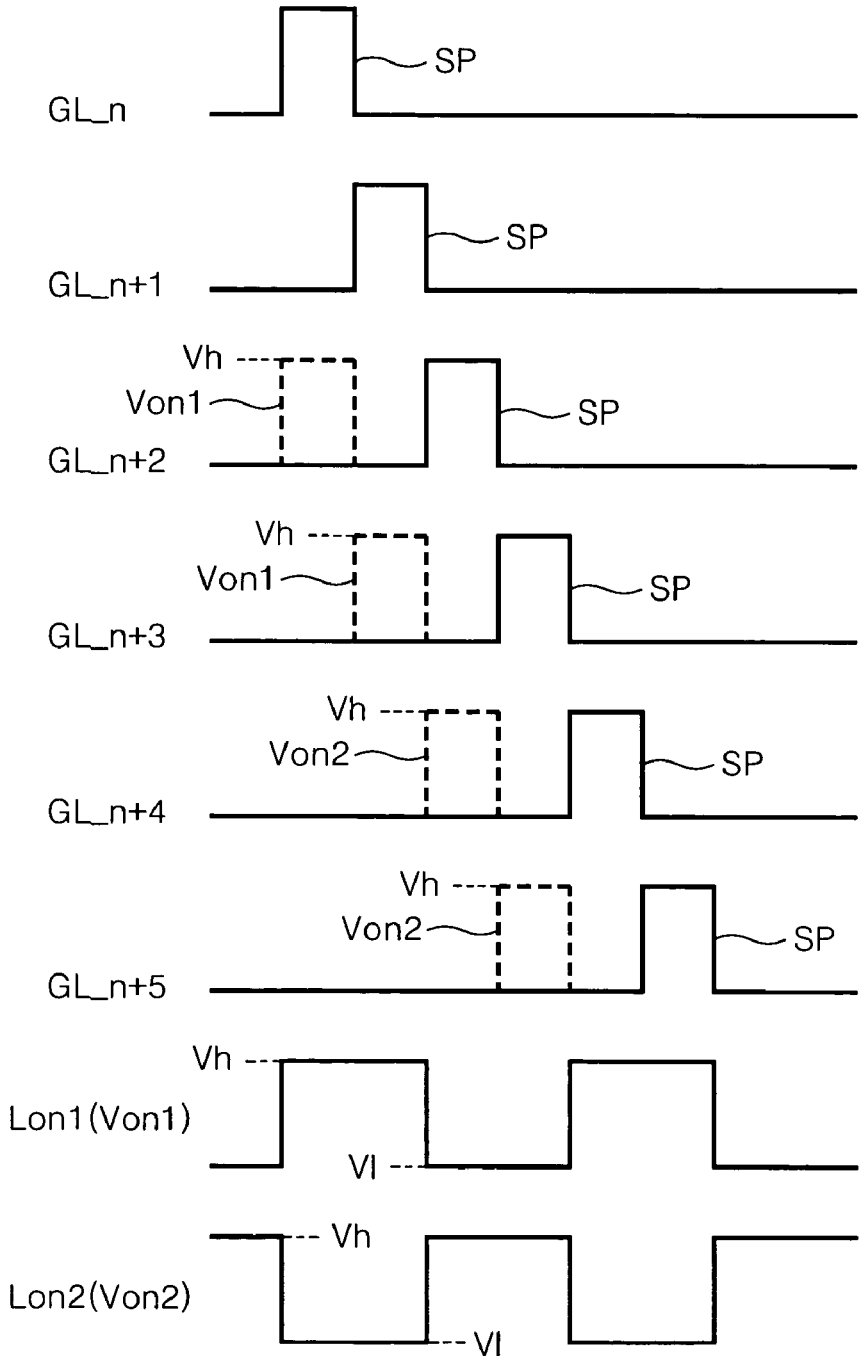
FIG. 5 is a view showing driving waveforms of the pre-charging circuit shown in FIG. 4.

FIG. 4 is a view illustrating the pre-charging circuit shown in FIG. 3, and FIG. 5 is a view showing driving waveforms of the pre-charging circuit shown in FIG. 4.

Referring to FIGS. 4 and 5, the pre-charging circuit 110 includes a plurality of second thin film transistors TFT2 to supply a voltage higher than a threshold voltage of the first thin film transistor TFT1 to the (n+2)th gate line GL_n+2 when a scanning pulse is supplied to the nth gate line GL_n; and voltage supply lines Lon1 and Lon2. The second thin film transistors TFT2 are connected to the gate lines GL_1 to GL_i, as shown in FIG. 4. The pre-charging circuit 110 may be formed together with the pixel array 112 through the same process as the pixel array 112 in the liquid crystal panel 103.

The voltage generator 108 generates first and second alternating current gate-on voltages Von1 and Von2 that are communicated to the pre-charging circuit 110 through the voltage supply lines Lon1 and Lon2, respectively. The first alternating current gate-on voltage Von1 has an opposite phase to the second alternating current gate-on voltage Von2. Such a voltage generator 108 may be formed on a printed circuit board (PCB).

Each of the second thin film transistors TFT2 may supply either the first alternating current gate-on voltage Von1 or the second alternating current gate-on voltage Von2 to the gate line GL_n+2 when the scanning pulse is supplied to the gate line GL_n.

The first alternating current gate-on voltage Von1 swings between a high gate voltage Vh higher than the threshold voltage of the first thin film transistor TFT1 and a low gate voltage Vl lower than the threshold voltage of the first thin film transistor TFT1 every two-horizontal periods, and the second alternating current gate-on voltage Von2 has the opposite phase to the first alternating current gate-on voltage Von1.

The nth second thin film transistor TFT2_n connected to the nth gate line GL_n supplies the high gate voltage Vh from the first voltage supply line Lon1 to the (n+2)th gate line GL_n+2 in response to the scanning pulse SP supplied to the nth gate line GL_n. To this end, a gate electrode of the nth second thin film transistor TFT2_n is connected to the nth gate line GL_n, its source electrode is connected to the first voltage supply line Lon1, and its drain electrode is connected to the (n+2)th gate line GL_n+2.

The (n+1)th second thin film transistor TFT2_n+1 connected to the (n+1)th gate line GL_n+1 supplies the high gate voltage Vh from the first voltage supply line Lon1 to the (n+3)th gate line GL_n+3 in response to the scanning pulse SP supplied to the (n+1)th gate line GL_n+1. To this end, a gate electrode of the (n+1)th second thin film transistor TFT2_n+1 is connected to the (n+1)th gate line GL_n+1, its source electrode is connected to the first voltage supply line Lon1, and its drain electrode is connected to the (n+3)th gate line GL_n+3.

The (n+2)th second thin film transistor TFT2_n+2 connected to the (n+2)th gate line GL_n+2 supplies the high gate voltage Vh from the second voltage supply line Lon2 to the (n+4)th gate line GL_n+4 in response to the scanning pulse SP supplied to the (n+2)th gate line GL_n+2. To this end, a gate electrode of the (n+2)th second thin film transistor TFT2_n+2 is connected to the (n+2)th gate line GL_n+2, its source electrode is connected to the second voltage supply line Lon2, and its drain electrode is connected to the (n+4)th gate line GL_n+4.

The (n+3)th second thin film transistor TFT2_n+3 connected to the (n+3)th gate line GL_n+3 supplies the high gate voltage Vh from the second voltage supply line Lon2 to the (n+5)th gate line GL_n+5 in response to the scanning pulse SP supplied to the (n+3)th gate line GL_n+3. To this end, a gate electrode of the (n+3)th second thin film transistor TFT2_n+3 is connected to the (n+3)th gate line GL_n+3, its source electrode is connected to the second voltage supply line Lon2, and its drain electrode is connected to the (n+5)th gate line GL_n+5.

The operation of the pre-charging circuit 110 according to the embodiment of the present invention will now be described.

First, when the scanning pulse SP is supplied to the nth gate line GL_n, the first thin film transistors TFT1 connected to the nth gate line GL_n are turned on to supply, for example, pixel voltages having a positive polarity (or a negative polarity) to the liquid crystal cells Clc connected to the first transistors TFT1. At this time, the nth second thin film transistor TFT2_n is also turned on by the scanning pulse SP, and the high gate voltage Vh is supplied to the (n+2)th gate line GL_n+2 from the first voltage supply line Lon1 via the nth second thin film transistor TFT2_n to thereby turn on the first thin film transistors TFT1 connected to the (n+2)th gate line GL_n+2. When the first thin film transistors TFT1 connected to the (n+2)th gate line GL_n+2 are turned on, the liquid crystal cells Clc connected to the first thin film transistors TFT1 are pre-charged with the pixel voltages of the positive polarity (or the negative polarity). At this time, the (n+2)th second thin film transistor TFT2_n+2 connected to the (n+2)th gate line GL_n+2 is turned on, so that the low gate voltage Vl is supplied to the (n+4)th gate line GL_n+4 from the second voltage supply line Lon2 to turn off the first thin film transistors TFT1 connected to the (n+4)th gate line GL_n+4.

Subsequently, when the scanning pulse SP is supplied to the (n+1)th gate line GL_n+1, the first thin film transistors TFT1 connected to the (n+1)th gate line GL_n+1 are turned on to supply pixel voltages having a positive polarity (or a negative polarity) to the liquid crystal cells Clc connected to the first transistors TFT1. At this time, the (n+1) second thin film transistor TFT2_n+1 is also turned on by the scanning pulse SP, and the high gate voltage Vh is supplied to the (n+3)th gate line GL_n+3 from the first voltage supply line Lon1 via the (n+1)th second thin film transistor TFT2_n+1 to thereby turn on the first thin film transistors TFT1 connected to the (n+3)th gate line GL_n+3. When the first thin film transistors TFT1 connected to the (n+3)th gate line GL_n+3 are turned on, the liquid crystal cells Clc connected to the first thin film transistors TFT1 are pre-charged with the pixel voltages having a positive polarity (or a negative polarity). At this time, the (n+3)th second thin film transistor TFT2_n+3 connected to the (n+3)th gate line GL_n+3 is turned on, so that the low gate voltage Vl is supplied to the (n+5)th gate line GL_n+5 from the second voltage supply line Lon2 to turn off the first thin film transistors TFT1 connected to the (n+5)th gate line GL_n+5.

Subsequently, when the scanning pulse SP is supplied to the (n+2)th gate line GL_n+2, the first thin film transistors TFT1 connected to the (n+2)th gate line GL_n+2 are turned on to supply pixel voltages having a positive polarity (or a negative polarity) to the liquid crystal cells Clc connected to the first transistors TFT1. At this time, the liquid crystal cells Clc pre-charged by the pixel voltages having the positive polarity (or the negative polarity) when driving the nth gate line GL_n are rapidly charged with the pixel voltages. The (n+2) second thin film transistor TFT2_n+2 is also turned on by the scanning pulse SP, and the high gate voltage Vh is supplied to the (n+4)th gate line GL_n+4 from the second voltage supply line Lon2 via the (n+2)th second thin film transistor TFT2_n+2 to thereby turn on the first thin film transistors TFT1 connected to the (n+4)th gate line GL_n+4. When the first thin film transistors TFT1 connected to the (n+4)th gate line GL_n+4 are turned on, the liquid crystal cells Clc connected to the first thin film transistors TFT1 are pre-charged with the pixel voltages having the positive polarity (or the negative polarity). At this time, the first alternating current gate-on voltage Von1 supplied to the first voltage supply line Lon1 is inverted to the low gate voltage VI and the (n+4)th second thin film transistor TFT2_n+4 connected to the (n+4)th gate line GL_n+4 is turned on, so that the low gate voltage VI is supplied to the (n+6)th gate line GL_n+6 from the first voltage supply line Lon1 to turn off the first thin film transistors TFT1 connected to the (n+6)th gate line GL_n+6.

Subsequently, when the scanning pulse SP is supplied to the (n+3)th gate line GL_n+3, the first thin film transistors TFT1 connected to the (n+3)th gate line GL_n+3 are turned on to supply pixel voltages having a positive polarity (or a negative polarity) to the liquid crystal cells Clc connected to the first transistors TFT1. At this time, the liquid crystal cells Clc pre-charged with the pixel voltages having the positive polarity (or the negative polarity) when driving the (n+1)th gate line GL_n+1 are rapidly charged with the pixel voltages. The (n+3) second thin film transistor TFT2_n+3 is also turned on by the scanning pulse SP, and the high gate voltage Vh is supplied to the (n+5)th gate line GL_n+5 from the second voltage supply line Lon2 via the (n+3)th second thin film transistor TFT2_n+3 to thereby turn on the first thin film transistors TFT1 connected to the (n+5)th gate line GL_n+5. When the first thin film transistors TFT1 connected to the (n+5)th gate line GL_n+5 are turned on, the liquid crystal cells Clc connected to the first thin film transistors TFT1 are pre-charged with the pixel voltages having the positive polarity (or the negative polarity). At this time, the (n+5)th second thin film transistor TFT2_n+5 connected to the (n+5)th gate line GL_n+5 is turned on, so that the low gate voltage Vl is supplied to the (n+7)th gate line GL_n+7 from the first voltage supply line Lon1 to turn off the first thin film transistors TFT1 connected to the (n+7)th gate line GL_n+7.

As mentioned above, the pre-charging circuit 110 according to the present invention pre-charges the liquid crystal cells Clc of the (n+2)th gate line GL_n+2 with the same polarity pixel voltages of the liquid crystal cells Clc of the nth gate line GL_n when driving the liquid crystal cells Clc of the nth gate line GL_n, thereby securing a sufficient time for charging the liquid crystal cells Clc of the (n+2)th gate line GL_n+2.

It is beneficial for middle to large-size LCD panels driven by the dot inversion method to secure a sufficient charging time by using a pre-charging method and thus to minimize picture deterioration caused by a response delay. When the first thin film transistors connected to the (n+4)th gate line GL_n4, the (n+6)th gate line GL_n+6, etc. are simultaneously turned on when pre-charging the liquid crystal cells Clc of the (n+2)th gate line GL_n+2 with the pixel voltages of the liquid crystal cells Clc of the nth gate line GL_n, a flicker or image sticking problem may occur on the LCD panel. In order to solve such a problem, the pre-charging circuit 110 according to the present invention alternately applies the first and the second alternating current gate-on voltages Von1 and Von2 by two gate lines to turn off the first thin film transistors TFT1 connected to the (n+4)th gate line GL_n+4, the (n+6)th gate line GL_n+6, etc. when pre-charging the liquid crystal cells Clc of the (n+2)th gate line GL_n+2 with the pixel voltages of the liquid crystal cells Clc of the nth gate line GL_n.

As described above, the liquid crystal display device and method of driving the same according to the present invention can secure sufficient charging time without modifying the structures of the gate driver integrated circuits, thereby reducing the production cost. Further, the pre-charging circuit of the present invention has a simple structure and may be formed together with the thin film transistors in the array panel. Accordingly, the pre-charging circuit of the present invention may be beneficially applicable for the COG (chip on glass ) type and SOP (system on panel) type liquid crystal panels.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a pixel array including a plurality of gate lines and a plurality of data lines crossing each other to define pixel regions and a plurality of first thin film transistors near the crossings, the first thin film transistors supplying pixel voltages to pixel electrodes of the pixel regions;

a gate driving circuit to sequentially supply a scanning pulse to the gate lines;

a data driving circuit to supply the pixel voltages to the data lines; and a pre-charging circuit including a plurality of second thin film transistors, the second thin film transistor connected to the nth gate line and turned on by the scanning pulse applied to the nth gate line, the pre-charging circuit supplying a voltage higher than a threshold voltage of the first thin film transistors to the (n+2)th gate line.

2. The display device according to claim 1, wherein the pre-charging circuit further includes:

a first voltage supply line supplied with a first alternating current gate-on voltage; and a second voltage supply line supplied with a second alternating current gate-on voltage.

3. The display device according to claim 2, wherein a voltage level of the first alternating current gate-on voltage and a voltage level of the second alternating current gate-on voltage are changed every two horizontal periods.

4. The display device according to claim 3, wherein a phase of the first alternating current gate-on voltage is opposite to a phase of the second alternating current gate-on voltage.

5. The display device according to claim 4, wherein the plurality of second thin film transistors include:

the nth second thin film transistor having a gate terminal connected to the nth gate line, a source terminal connected to the first voltage supply line, and a drain terminal connected to the (n+2)th gate line;

the (n+1)th second thin film transistor having a gate terminal connected to the (n+1)th gate line, a source terminal connected to the first voltage supply line, and a drain terminal connected to the (n+3)th gate line;

the (n+2)th second thin film transistor having a gate terminal connected to the (n+2)th gate line, a source terminal connected to the second voltage supply line, and a drain terminal connected to the (n+4)th gate line; and the (n+3)th second thin film transistor having a gate terminal connected to the (n+3)th gate line, a source terminal connected to the second voltage supply line, and a drain terminal connected to the (n+5)th gate line.

6. The display device according to claim 1, wherein the pre-charging circuit is formed on the same substrate together with the gate lines, the data lines and the first thin film transistors.

7. The display device according to claim 2, further comprising a voltage generator for generating the first alternating current gate-on voltage and the second alternating current gate-on voltage.

8. The display device according to claim 1, wherein the data driving circuit supplies the pixel voltages to the data lines according to a dot inversion method.

9. The display device according to claim 1, wherein the data driving circuit supplies the pixel voltages to the data lines according to a line inversion method.

10. A method of driving a display device, the display device including a pixel array in which a plurality of gate lines cross a plurality of data lines to define pixel regions and a plurality of first thin film transistors near the crossings, the first thin film transistors supplying pixel voltages to pixel electrodes of the pixel regions, the method comprising:

sequentially supplying a scanning pulse to the gate lines;

supplying the pixel voltages to the data lines according to a dot inversion method; and supplying a voltage higher than a threshold of the first thin film transistors to the (n+2)th gate line using a second thin film transistor turned on in accordance with the scanning pulse supplied to the nth gate line.

11. The method according to claim 10, wherein the voltage higher than the threshold of the first thin film transistors to the (n+2)th gate line includes a first alternating current gate-on voltage and a second alternating current gate-on voltage.

12. The method according to claim 11, wherein a voltage level of the first alternating current gate-on voltage and a voltage level of the second alternating current gate-on voltage are changed every two horizontal periods.

13. The method according to claim 12, wherein a phase of the first alternating current gate-on voltage is opposite to a phase of the second alternating current gate-on voltage.

14. The method according to claim 12, wherein said supplying the voltage higher than the threshold voltage includes:

supplying the first alternating current gate-on voltage to the (n+2)th gate line using the nth second thin film transistor connected to the nth gate line;

supplying the first alternating current gate-on voltage to the (n+3)th gate line using the (n+1)th second thin film transistor connected to the (n+1)th gate line;

supplying the second alternating current gate-on voltage to the (n+4)th gate line using the (n+2)th second thin film transistor connected to the (n+2)th gate line; and supplying the second alternating current gate-on voltage to the (n+5)th gate line using the (n+3)th second thin film transistor connected to the (n+3)th gate line.

15. The method according to claim 10, wherein when supplying the voltage higher than the threshold of the first thin film transistors to the (n+2)th gate line using the nth second thin film transistor connected to the nth gate line, the first thin film transistors connected to the (n+4)th gate line are turned off.

16. A pre-charge device for pre-charging pixels of a display device having a plurality of gate lines and a plurality of data lines crossing each other and a plurality of first thin film transistors near the crossings for supplying pixel voltages to the pixels, the pre-charge device comprising:

a voltage generator to supply a voltage higher than a threshold voltage of the first thin film transistors; and a plurality of second thin film transistors, one of the second thin film transistors turned on by a scanning pulse applied to the nth (wherein, n is an integer) gate line to supply the voltage higher than the threshold voltage of the first thin film transistors to the (n+2)th gate line.

17. The pre-charge device according to claim 16, wherein the pre-charge device further includes:

a first voltage supply line supplied with a first alternating current gate-on voltage; and a second voltage supply line supplied with a second alternating current gate-on voltage.

18. The pre-charge device according to claim 17, wherein a voltage level of the first alternating current gate-on voltage and a voltage level of the second alternating current gate-on voltage are changed every two horizontal periods.

19. The pre-charge device according to claim 18, wherein a phase of the first alternating current gate-on voltage is opposite to a phase of the second alternating current gate-on voltage.

20. The pre-charge device according to claim 19, wherein the second thin film transistors include:

the nth second thin film transistor having a gate terminal connected to the nth gate line, a source terminal connected to the first voltage supply line, and a drain terminal connected to the (n+2)th gate line;

the (n+1)th second thin film transistor having a gate terminal connected to the (n+1)th gate line, a source terminal connected to the first voltage supply line, and a drain terminal connected to the (n+3)th gate line;

the (n+2)th second thin film transistor having a gate terminal connected to the (n+2)th gate line, a source terminal connected to the second voltage supply line, and a drain terminal connected to the (n+4)th gate line; and the (n+3)th second thin film transistor having a gate terminal connected to the (n+3)th gate line, a source terminal connected to the second voltage supply line, and a drain terminal connected to the (n+5)th gate line.

* * * * *